US010626727B2

(12) United States Patent
Chouhan et al.

(10) Patent No.: US 10,626,727 B2
(45) Date of Patent: Apr. 21, 2020

(54) TURBINE BUCKET FOR CONTROL OF WHEELSPACE PURGE AIR

(71) Applicant: General Electric Company, Schenectady, NY (US)

(72) Inventors: Rohit Chouhan, Bangalore (IN); Soumyik Kumar Bhaumik, Bangalore (IN); Clint Luigie Ingram, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 825 days.

(21) Appl. No.: 14/603,316

(22) Filed: Jan. 22, 2015

(65) Prior Publication Data

US 2016/0215624 A1 Jul. 28, 2016

(51) Int. Cl.

| | |
|---|---|
| ***F01D 5/14*** | (2006.01) |
| ***F01D 11/04*** | (2006.01) |
| ***F01D 5/08*** | (2006.01) |
| ***F01D 11/00*** | (2006.01) |

(52) U.S. Cl.

CPC ..... *F01D 5/145* (2013.01); *F01D 5/08* (2013.01); *F01D 5/081* (2013.01); *F01D 5/082* (2013.01); *F01D 5/085* (2013.01); *F01D 5/087* (2013.01); *F01D 5/14* (2013.01); *F01D 11/001* (2013.01); *F05D 2260/20* (2013.01)

(58) Field of Classification Search

None

See application file for complete search history.

(56) References Cited

U.S. PATENT DOCUMENTS

| | | | |
|---|---|---|---|
| 5,211,533 | A | 5/1993 | Walker et al. |
| 5,222,742 | A | 6/1993 | Roberts |
| 5,417,545 | A | 5/1995 | Harrogate |
| 5,893,984 | A | 4/1999 | Thompson |
| 6,077,035 | A | 7/2000 | Walters et al. |
| 6,783,323 | B2 | 8/2004 | Shiozaki et al. |

(Continued)

FOREIGN PATENT DOCUMENTS

| | | | |
|---|---|---|---|
| CN | 102678189 | A | 9/2012 |
| CN | 104937215 | B | 8/2017 |

(Continued)

OTHER PUBLICATIONS

European Search Report and Opinion in relation to U.S. Appl. No. 14/603,316 dated Jun. 28, 2016, 7 pages.

(Continued)

*Primary Examiner* — Igor Kershteyn
*Assistant Examiner* — Jason G Davis
(74) *Attorney, Agent, or Firm* — Dale Davis; Hoffman Warnick LLC

(57) ABSTRACT

Embodiments of the invention relate generally to rotary machines and, more particularly, to the control of wheel space purge air in gas turbines. In one embodiment, the invention provides a turbine bucket comprising: a platform portion; an airfoil extending radially outward from the platform portion; a shank portion extending radially inward from the platform portion; an angel wing extending axially from a face of the shank portion; and a plurality of voids disposed along a length of the angel wing, each of the plurality of voids extending radially through the angel wing.

13 Claims, 7 Drawing Sheets

(56) References Cited

U.S. PATENT DOCUMENTS

| | | | | |
|---|---|---|---|---|
| 7,044,710 | B2 | 5/2006 | Naik et al. | |
| 7,114,339 | B2 | 10/2006 | Alvanos et al. | |
| 7,189,055 | B2 * | 3/2007 | Marini | F01D 5/081 415/115 |
| 7,189,056 | B2 | 3/2007 | Girgis et al. | |
| 7,244,104 | B2 | 7/2007 | Girgis et al. | |
| 7,665,964 | B2 | 2/2010 | Taylor et al. | |
| 8,057,178 | B2 | 11/2011 | Itzel et al. | |
| 8,083,475 | B2 | 12/2011 | Bulgrin et al. | |
| 8,186,952 | B2 | 5/2012 | Tibbott | |
| 8,419,356 | B2 | 4/2013 | Little | |
| 8,834,122 | B2 | 9/2014 | Ingram | |
| 8,939,711 | B2 * | 1/2015 | Lee | F01D 11/001 415/116 |
| 8,979,481 | B2 | 3/2015 | Ingram | |
| 9,039,357 | B2 | 5/2015 | Lee | |
| 9,121,298 | B2 | 9/2015 | Lee et al. | |
| 2006/0269399 | A1 | 11/2006 | Girgis et al. | |
| 2010/0074733 | A1 | 3/2010 | Little | |
| 2010/0074734 | A1 | 3/2010 | Little | |
| 2012/0163955 | A1 | 6/2012 | Devi et al. | |
| 2012/0251291 | A1 * | 10/2012 | Ledezma | F01D 5/082 415/1 |
| 2013/0108441 | A1 | 5/2013 | Ingram | |
| 2013/0108451 | A1 | 5/2013 | Ingram | |
| 2013/0139386 | A1 | 6/2013 | Lacy et al. | |
| 2013/0170983 | A1 | 7/2013 | Babu et al. | |
| 2013/0189073 | A1 | 7/2013 | Adaickalasamy | |
| 2013/0302141 | A1 * | 11/2013 | Quach | F01D 5/145 415/115 |
| 2014/0003919 | A1 | 1/2014 | Lee et al. | |
| 2014/0147250 | A1 | 5/2014 | Lee et al. | |
| 2014/0205441 | A1 | 7/2014 | Lee | |
| 2014/0205443 | A1 | 7/2014 | Lee et al. | |
| 2014/0234076 | A1 | 8/2014 | Lee et al. | |
| 2014/0271111 | A1 * | 9/2014 | Ballard, Jr. | F01D 11/24 415/1 |
| 2014/0286760 | A1 | 9/2014 | Lee | |

FOREIGN PATENT DOCUMENTS

| | | | |
|---|---|---|---|
| DE | 10 2006 043 744 | A1 | 3/2007 |
| EP | 1 895 108 | A2 | 3/2008 |
| EP | 2 116 692 | A2 | 11/2009 |
| EP | 2581555 | A1 | 4/2013 |
| EP | 2586995 | A2 | 5/2013 |
| EP | 2586996 | A2 | 5/2013 |
| GB | 2251040 | A | 6/1992 |
| JP | 2004036510 | A | 2/2004 |
| JP | 2004100578 | A | 4/2004 |
| JP | 2005036722 | A | 2/2005 |
| JP | 2006077658 | A | 3/2006 |
| JP | 2013119855 | A | 6/2013 |
| JP | 2013151936 | A | 8/2013 |
| JP | 2016501341 | A | 1/2016 |
| JP | 2016505771 | A | 2/2016 |
| WO | 2011029420 | A1 | 3/2011 |

OTHER PUBLICATIONS

European Search Report and Opinion in relation to U.S. Appl. No. 14/603,321 dated Jun. 28, 2016, 5 pages.
European Search Report and Opinion in related to U.S. Appl. No. 14/635,352, dated Jul. 12, 2016, 8 pages.
Extended European Search Report and Opinion issued in connection with related EP Application No. 16152213.1 dated Dec. 21, 2016.
U.S. Appl. No. 14/635,352, Office Action 1 dated Mar. 9, 2017, 42 pages.
U.S. Appl. No. 14/603,314, Office Action 1 dated Mar. 24, 2017, 40 pages.
U.S. Appl. No. 14/603,321, Office Action 1 dated Apr. 13, 2017, 30 pages.
Chouhan, et al. filed Jul. 22, 2016, U.S. Appl. No. 15/216,881.
Chouhan, et al. filed Sep. 7, 2016, U.S. Appl. No. 15/257,986.
U.S. Appl. No. 14/603,318, Office Action 1 dated Jun. 14, 2017, 26 pages.
U.S. Appl. No. 15/217,212, Office Action 1 dated Jul. 3, 2017, 16 pages.
U.S. Appl. No. 14/603,314, Final Office Action 1 dated Jul. 13, 2017, 17 pages.
U.S. Appl. No. 14/635,352, Office Action 2 dated Sep. 13, 2017, 12 pages.
U.S. Appl. No. 15/217,212, Office Action 2 dated Dec. 14, 2017, 14 pages.
U.S. Appl. No. 14/603,314, Office Action dated Dec. 29, 2017, 27 pages.
U.S. Appl. No. 14/603,321, Office Action dated Mar. 7, 2018, 10 pages.
U.S. Appl. No. 14/635,352, Office Action dated Mar. 29, 2018, 14 pages.
U.S. Appl. No. 14/603,314, Final Office Action dated Apr. 3, 2018, 13 pages.
U.S. Appl. No. 14/603,318, Office Action dated Apr. 3, 2018, 12 pages.
U.S. Appl. No. 15/217,212, Final Office Action dated Apr. 5, 2018, 14 pages.
U.S. Appl. No. 14/603,321, Final Office Action dated Mar. 28, 2019, 12 pgs.
U.S. Appl. No. 15/216,881, Final Office Action dated Apr. 4, 2019, 9 pages.
U.S. Appl. No. 15/217,212, Final Office Action dated Apr. 12, 2019, 9 pages.
U.S. Appl. No. 14/603,314, Final Office Action dated May 1, 2019, 10 pages.
U.S. Appl. No. 14/635,352, Final Office Action dated Jun. 29, 2018, 8 pages.
U.S. Appl. No. 14/603,318 Final Office Action dated Sep. 7, 2018, 25 pages.
Office Action and English Translation thereof for Chinese Patent Application No. 201610116856.4 dated Dec. 24, 2018, 15 pages.
Office Action and English Translation thereof for Chinese Patent Application No. 201610042608.X dated Oct. 22, 2018, 18 pages.
U.S. Appl. No. 15/216,881, Office Action dated Jul. 18, 2019, 16 pages.
U.S. Appl. No. 14/603,321, Office Action dated Jul. 29, 2019, 15 pages.
U.S. Appl. No. 14/603,316, Office Action dated Sep. 12, 2019, 14 pages.
U.S. Appl. No. 14/603,321, Final Office Action dated Sep. 20, 2019, 9 pages.
U.S. Appl. No. 15/216,881, Office Action 2 dated Sep. 26, 2019, 9 pages.
U.S. Appl. No. 15/217,212, Office Action dated Oct. 2, 2019, 8 pages.
U.S. Appl. No. 14/603,314, Notice of Allowance dated Oct. 2, 2019, 8 pages.
U.S. Appl. No. 14/603,321, Notice of Allowance dated Nov. 6, 2019, 6 pages.
U.S. Appl. No. 15/216,881, Notice of Allowance dated Dec. 20, 2019, 17 pages.
Japanese Office Action Report and Opinion issued in connection with corresponding JP Application No. 2016005703 dated Oct. 31, 2019, 8 pages.
Japanese Office Action Report and Opinion issued in connection with corresponding JP Application No. 2016005741 dated Oct. 23, 2019, 8 pages.
U.S. Appl. No. 15/217,212, Final Office Action dated Jan. 24, 2020, 8 pages.
Machine translation of Office Action issued by Japanese Patent Office dated Nov. 12, 2019, for corresponding JP Application Serial No. 2016-005704.

* cited by examiner

TURBINE BUCKET FOR CONTROL OF WHEELSPACE PURGE AIR

BACKGROUND OF THE INVENTION

Embodiments of the invention relate generally to rotary machines and, more particularly, to the control of wheel space purge air in gas turbines.

As is known in the art, gas turbines employ rows of buckets on the wheels/disks of a rotor assembly, which alternate with rows of stationary vanes on a stator or nozzle assembly. These alternating rows extend axially along the rotor and stator and allow combustion gasses to turn the rotor as the combustion gasses flow therethrough.

Axial/radial openings at the interface between rotating buckets and stationary nozzles can allow hot combustion gasses to exit the hot gas path and radially enter the intervening wheelspace between bucket rows. To limit such incursion of hot gasses, the bucket structures typically employ axially-projecting angel wings, which cooperate with discourager members extending axially from an adjacent stator or nozzle. These angel wings and discourager members overlap but do not touch, and serve to restrict incursion of hot gasses into the wheelspace.

In addition, cooling air or "purge air" is often introduced into the wheelspace between bucket rows. This purge air serves to cool components and spaces within the wheelspaces and other regions radially inward from the buckets as well as providing a counter flow of cooling air to further restrict incursion of hot gasses into the wheelspace. Angel wing seals therefore are further designed to restrict escape of purge air into the hot gas flowpath.

Nevertheless, most gas turbines exhibit a significant amount of purge air escape into the hot gas flowpath. For example, this purge air escape may be between 0.1% and 3.0% at the first and second stage wheelspaces. The consequent mixing of cooler purge air with the hot gas flowpath results in large mixing losses, due not only to the differences in temperature but also to the differences in flow direction or swirl of the purge air and hot gasses.

BRIEF DESCRIPTION OF THE INVENTION

In one embodiment, the invention provides a turbine bucket comprising: a platform portion; an airfoil extending radially outward from the platform portion; a shank portion extending radially inward from the platform portion; an angel wing extending axially from a face of the shank portion; and a plurality of voids disposed along a length of the angel wing, each of the plurality of voids extending radially through the angel wing.

In another embodiment, the invention provides a gas turbine comprising: a diffuser; and a last stage turbine bucket adjacent the diffuser, the last stage turbine bucket including: an airfoil extending radially outward from a platform portion; a shank portion extending radially inward from the platform portion; and an angel wing extending axially from a face of the shank portion, the angel wing including a plurality of voids disposed along a length of the angel wing, each of the plurality of voids extending radially through the angel wing.

In yet another embodiment, the invention provides a turbine bucket comprising: angel wing; and a plurality of voids along a length of the angel wing, wherein each of the plurality of voids includes a concave face extending radially through the angel wing and angled with respect to both a longitudinal axis of the turbine bucket and a direction of rotation of the turbine bucket.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements among the drawings.

DETAILED DESCRIPTION OF THE INVENTION

Figure 1:
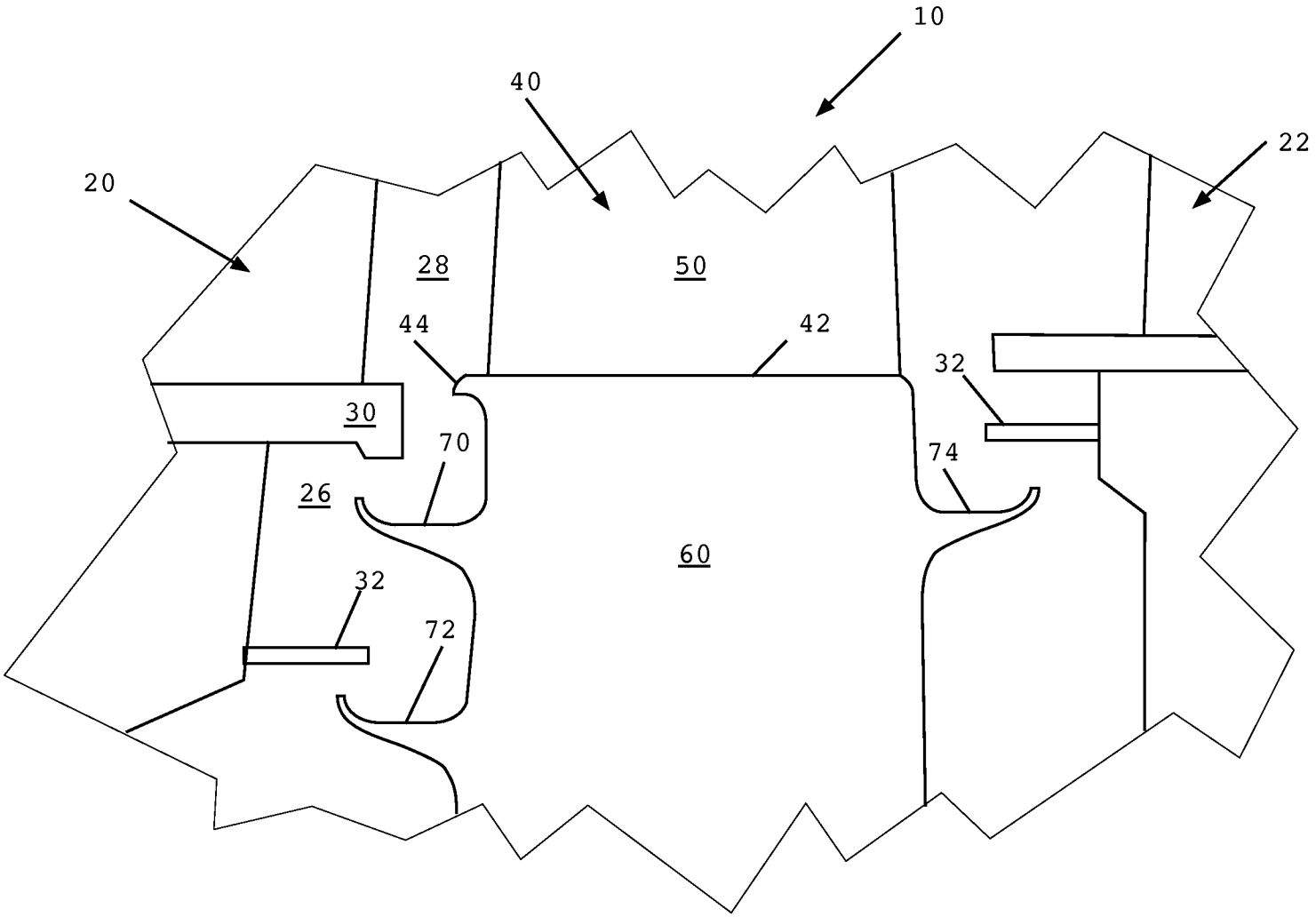
FIG. 1 shows a schematic cross-sectional view of a portion of a known turbine.

Turning now to the drawings, FIG. 1 shows a schematic cross-sectional view of a portion of a gas turbine 10 including a bucket 40 disposed between a first stage nozzle 20 and a second stage nozzle 22. Bucket 40 extends radially outward from an axially extending rotor (not shown), as will be recognized by one skilled in the art. Bucket 40 comprises a substantially planar platform 42, an airfoil extending radially outward from platform 42, and a shank portion 60 extending radially inward from platform 42.

Shank portion 60 includes a pair of angel wing seals 70, 72 extending axially outward toward first stage nozzle 20 and an angel wing seal 74 extending axially outward toward second stage nozzle 22. It should be understood that differing numbers and arrangements of angel wing seals are possible and within the scope of the invention. The number and arrangement of angel wing seals described herein are provided merely for purposes of illustration.

As can be seen in FIG. 1, nozzle surface 30 and discourager member 32 extend axially from first stage nozzle 20 and are disposed radially outward from each of angel wing seals 70 and 72, respectively. As such, nozzle surface 30 overlaps but does not contact angel wing seal 70 and discourager member 32 overlaps but does not contact angel wing seal 72. A similar arrangement is shown with respect to discourager member 32 of second stage nozzle 22 and angel wing seal 74. In the arrangement shown in FIG. 1, during operation of the turbine, a quantity of purge air may be disposed between, for example, nozzle surface 30, angel wing seal 70, and platform lip 44, thereby restricting both escape of purge air into hot gas flowpath 28 and incursion of hot gasses from hot gas flowpath 28 into wheelspace 26.

While FIG. 1 shows bucket 40 disposed between first stage nozzle 20 and second stage nozzle 22, such that bucket 40 represents a first stage bucket, this is merely for purposes of illustration and explanation. The principles and embodiments of the invention described herein may be applied to a bucket of any stage in the turbine with the expectation of achieving similar results.

Figure 2:
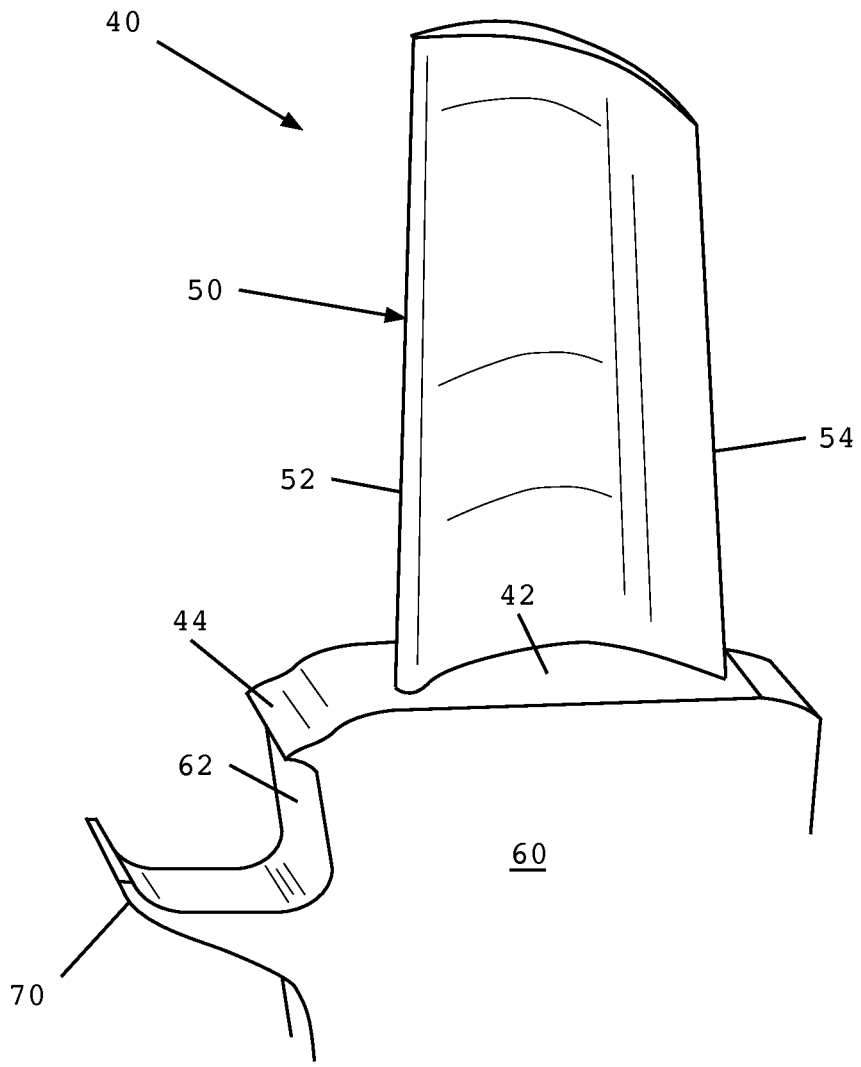
FIG. 2 shows a perspective view of a known turbine bucket.

FIG. 2 shows a perspective view of a portion of bucket 40. As can be seen, airfoil 50 includes a leading edge 52 and a trailing edge 54. Shank portion 60 includes a face 62 nearer leading edge 52 than trailing edge 54, disposed between angel wing 70 and platform lip 44.

Figure 3:
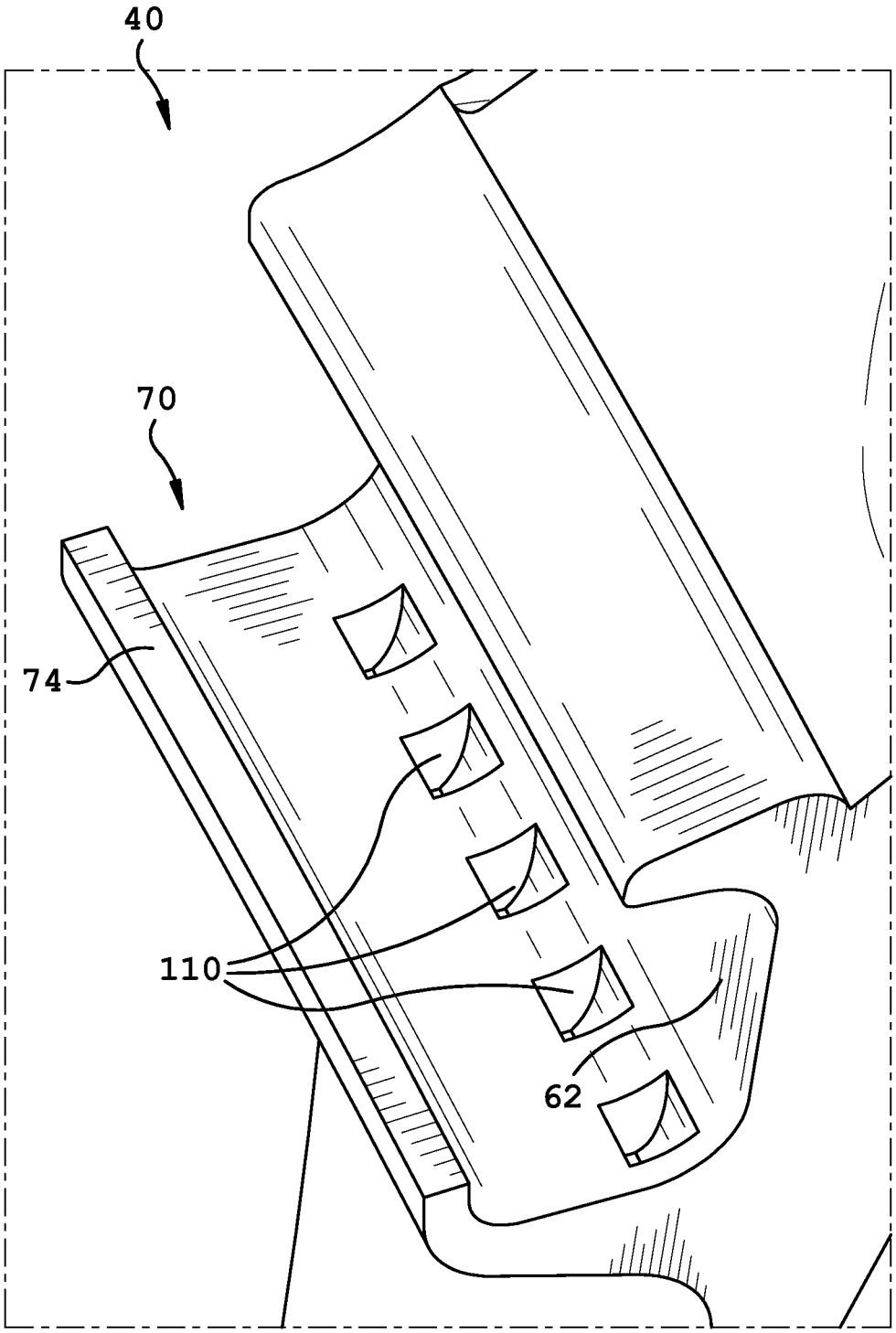
FIG. 3 shows a perspective view of a portion of a turbine bucket according to an embodiment of the invention.
Figure 4:
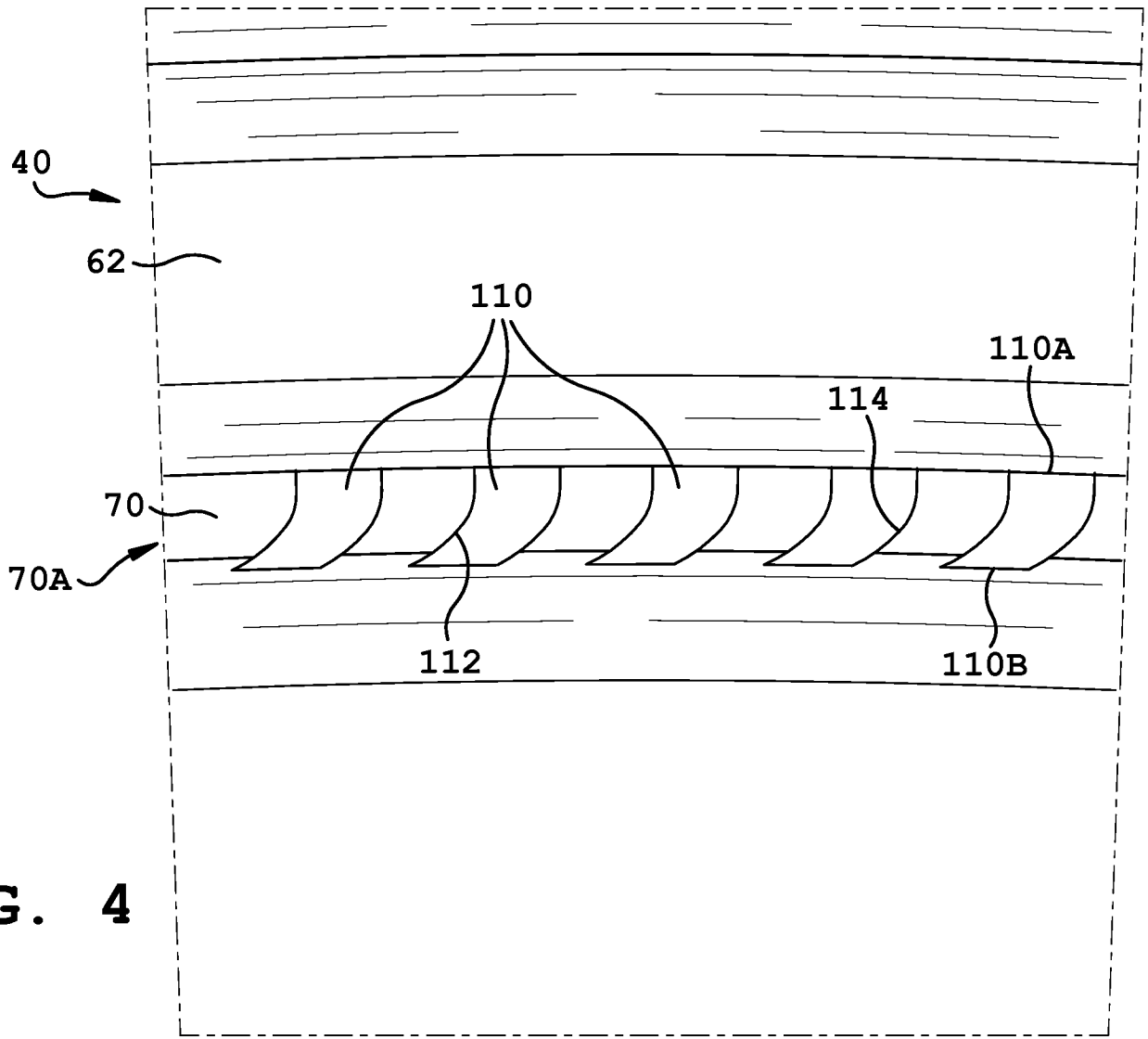
FIG. 4 shows an axially-inwardly looking view of a portion of the turbine bucket of FIG. 3.

FIG. 3 shows a perspective view of a portion of a turbine bucket 40 according to an embodiment of the invention. As can be seen in FIG. 3, a plurality of voids 110 extend radially through angel wing 70. As shown in FIG. 3, the plurality of voids 110 is disposed axially inwardly along angel wing 70, closer to face 62 than angel wing rim 74. Each of the plurality of voids 110 is shown in FIG. 4 having a rectangular cross-sectional shape (i.e., a rectangular shape looking radially inward), although this is neither necessary nor essential. As will be recognized by one skilled in the art, any number of cross-sectional shapes may be employed and are within the scope of the invention.

As shown in FIG. 3, the plurality of voids 110 is substantially evenly disposed along a length of angel wing 70. It is noted, however, that this is neither necessary nor essential. According to other embodiments of the invention, the plurality of voids 110 may be unevenly disposed along the length of angel wing 70, such that voids are more numerous at one end of angel wing 70 than the other end, are more numerous toward a middle portion of angel wing 70, or any other configuration.

FIG. 4 shows an axially-inwardly looking cross-sectional view of a portion of turbine bucket 40 taken through angel wing 70. As can be seen in FIG. 4, and according to one embodiment of the invention, voids 110 include a convex face 112 and a concave face 114, forming a curved or arcuate passage through angel wing 70. That is, voids 110 follow a path from radially outward opening 110A, along convex face 112 and concave face 114, to radially inward opening 110B. Radially inward opening 110B is thereby disposed closer to end 70A of angel wing 70 than is radially outward opening 110A, i.e. radially outward opening 110B trails radially inward opening 110A with respect to a direction of rotation of turbine bucket 40.

This curved or arcuate shape of voids 110 through angel wing 70 increases a swirl velocity of purge air between angel wing 70 and platform lip 44. As will be explained in greater detail below, this produces a curtaining effect, restricting incursion of hot gas into wheelspace 26 (FIG. 1) while simultaneously reducing the quantity of purge air escaping from wheelspace 26.

Figure 5:
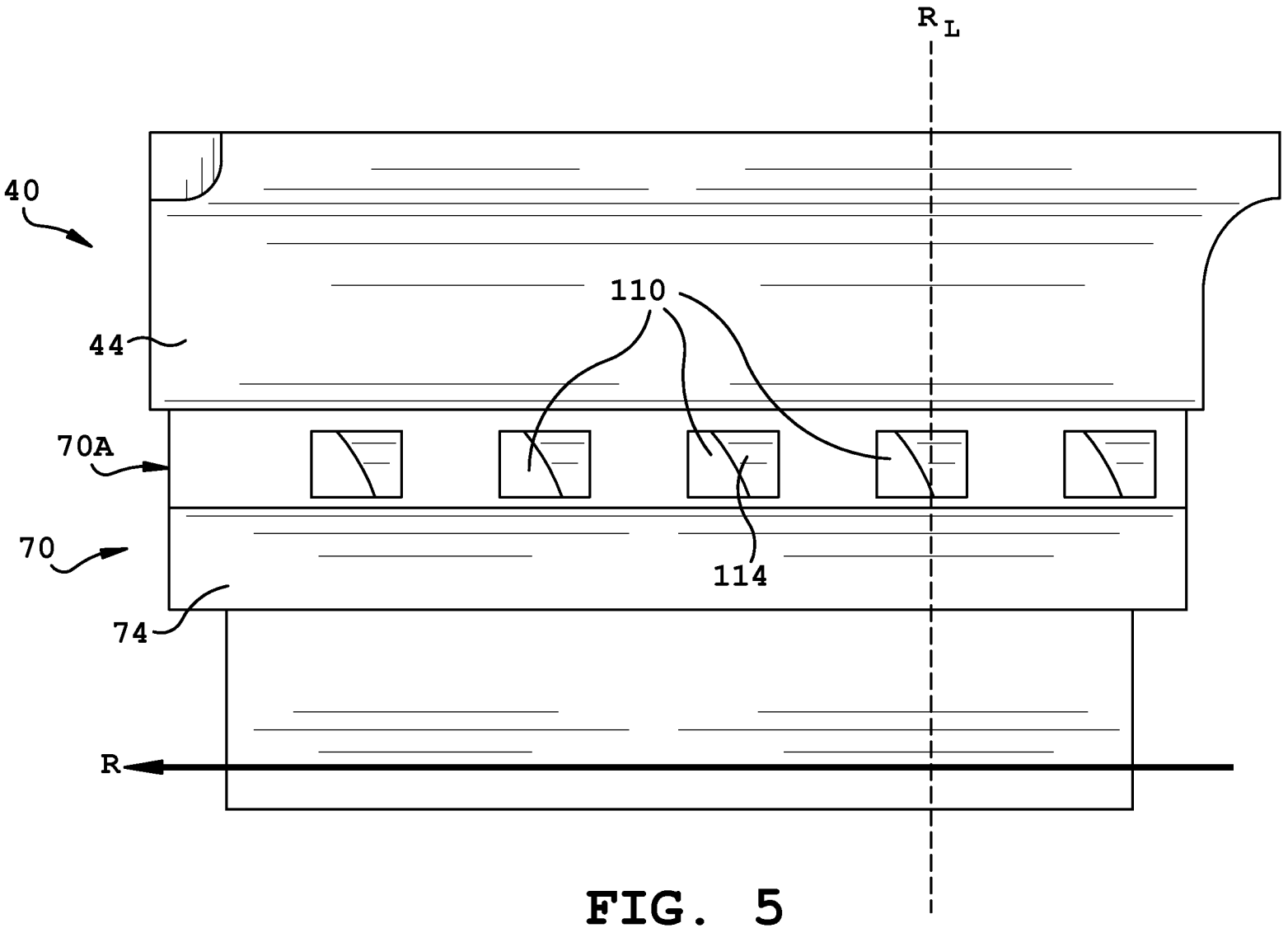
FIG. 5 shows a radially-downward looking view of a portion of the turbine bucket of FIG. 3.

FIG. 5 shows a radially-downward looking view of a portion of turbine bucket 40. Concave faces 114 of each void 110 can be seen. In addition, as shown in FIG. 4, concave faces 114 are axially angled as well. That is, concave faces 114 are angled with respect to both a longitudinal axis $R_L$ and a direction of rotation R of turbine bucket 40. Thus, the shape of voids 110 as they pass radially outward through angel wing 70 would impart a swirl to the purge gas, directing the purge gas both axially, toward angel wing rim 74 and laterally toward end 70A of angel wing 70.

Figure 7:
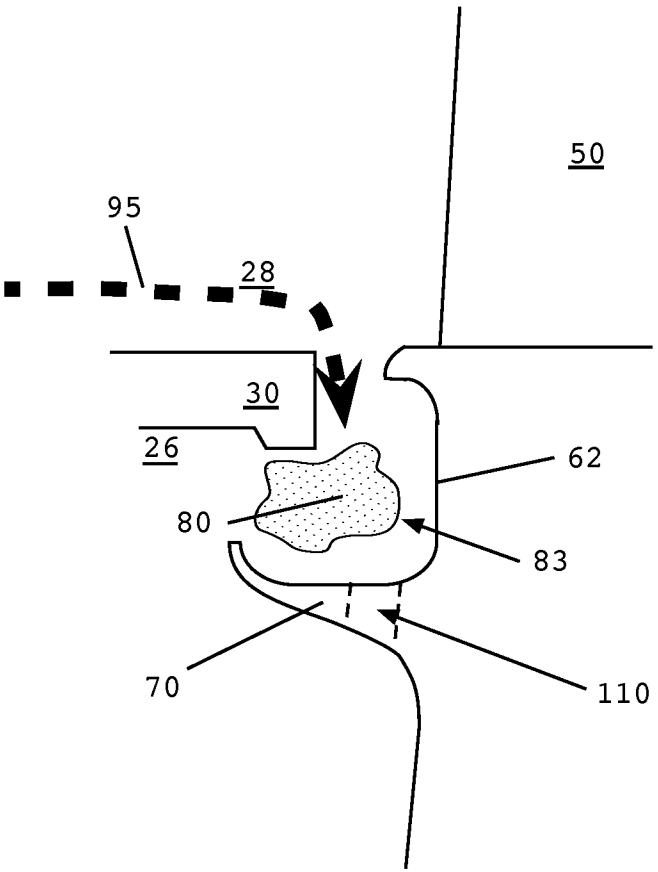
FIG. 7 shows a schematic view of purge air flow in a turbine bucket according to an embodiment of the invention.
Figure 6:
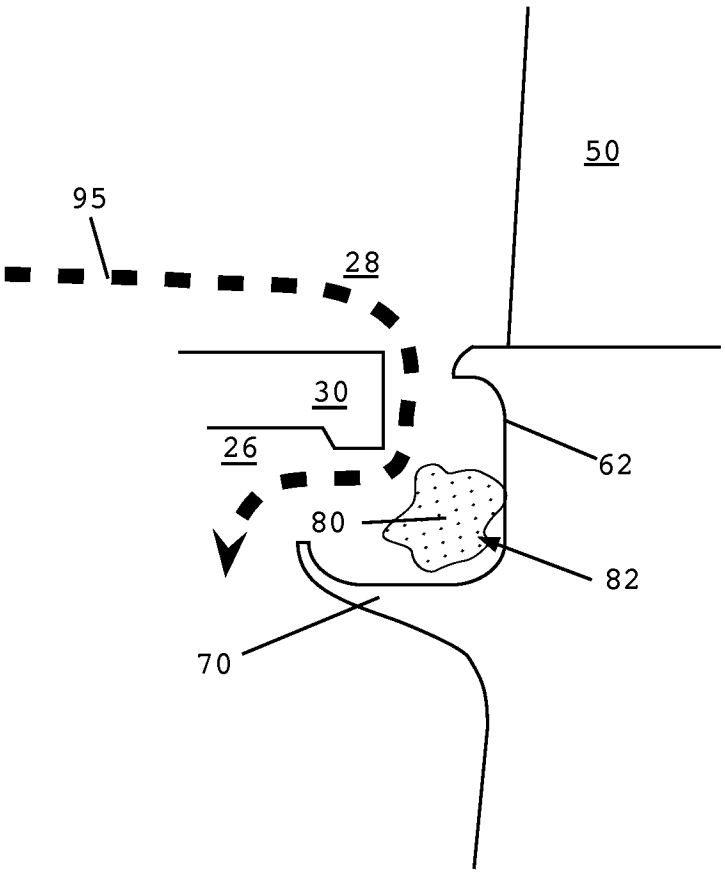
FIG. 6 PRIOR ART
FIG. 6 shows a schematic view of purge air flow in a known turbine bucket.

FIG. 6 shows a schematic view of purge air flow in a known turbine bucket. Purge air 80 is shown concentrated and having a higher swirl velocity in area 82, closer to face 62. In contrast, FIG. 7 is a schematic view showing the effect of voids 110 (FIG. 5) on purge air 80 according to various embodiments of the invention. Here, area 83, in which purge air 80 is concentrated and exhibits a higher swirl velocity is distanced further from face 62, as compared to FIG. 6. This, in effect, produces a curtaining effect at area 83, restricting incursion of hot gas 95 from hot gas flowpath 28 while at the same time reducing the quantity of purge air 80 escaping from wheelspace 26 into hot gas flowpath 28.

The increases in turbine efficiencies achieved using embodiments of the invention can be attributed to a number of factors. First, as noted above, increases in swirl velocity reduce the escape of purge air into hot gas flowpath 28, increases in swirl reduce the mixing losses attributable to any purge air that does so escape, and the curtaining effect induced by voids according to the invention reduce or prevent the incursion of hot gas into wheelspace 26. Each of these contributes to the increased efficiencies observed.

In addition, the overall quantity of purge air needed is reduced for at least two reasons. First, a reduction in escaping purge air necessarily reduces the purge air that must be replaced, which has a direct, favorable effect on turbine efficiency. Second, a reduction in the incursion of hot gas into wheelspace 26 reduces the temperature rise within wheelspace 26 and the attendant need to reduce the temperature through the introduction of additional purge air. Each of these reductions to the total purge air required reduces the demand on the other system components, such as the compressor from which the purge air is provided.

While reference above is made to the ability of voids in an angel wing to change the swirl velocity of purge air within a wheelspace, and particularly within a wheelspace adjacent early stage turbine buckets, it should be noted that such angel wing voids may be employed on turbine buckets of any stage with similar changes to purge air swirl velocity and angle. In fact, Applicants have noted a very favorable result when angel wing rim voids are employed in the last stage bucket (LSB).

Spikes in total pressure ($P_T$) and swirl profiles at the inner radius region of the diffuser inlet are a consequence of a mismatch between the hot gas flow and the swirl of purge air exiting the wheelspace adjacent the LSB. Applicants have found that angel wing voids according to various embodiments of the invention are capable of both increasing $P_T$ spikes at a diffuser inlet close to the inner radius while at the same time decreasing swirl spikes at or near the same location. Each of these improves diffuser performance. Angel wing voids, for example, have been found to change the swirl angle of purge air exiting the LSB wheelspace by 1-3 degrees while also increasing $P_T$ spikes by 15-30%.

Figure 8:
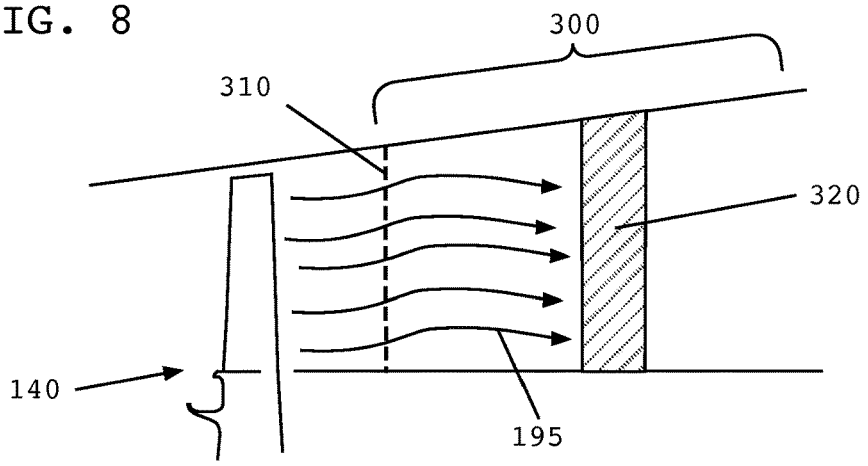
FIG. 8 shows a schematic view of a last stage turbine bucket and diffuser according to an embodiment of the invention.

FIG. 8 shows a schematic view of a LSB 140 adjacent diffuser 300. Hot gas 195 enters diffuser 300 at diffuser inlet plane 310 and passes toward struts 320. Voids according to embodiments of the invention reduce the swirl mismatch of purge air as it combines with hot gas 195, preventing separation of hot gas 195 as it enters struts 320. At the same time, voids increase the $P_T$ spike.

Figure 9:
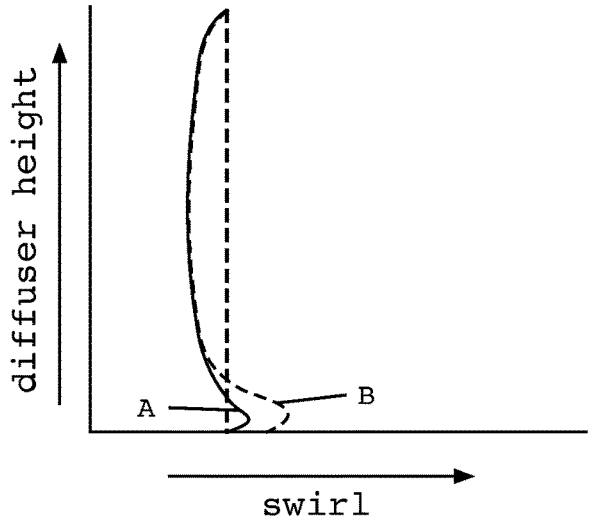
FIG. 9 shows a graph of swirl spike profiles at a diffuser inlet plane for known turbines and turbines according to embodiments of the invention.

FIG. 9 shows a graph of swirl spike as a function of diffuser inlet plane height. Profile A represents a swirl spike profile for a turbine having angel wing voids according to embodiments of the invention. Profile B represents a swirl spike profile for a turbine having angel wings known in the art. Profile A exhibits a marked decrease in swirl spike at a radially inward position of the diffuser inlet plane.

Figure 10:
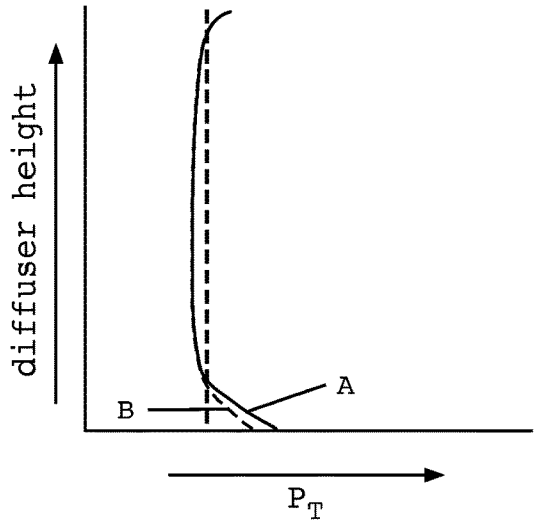
FIG. 10 shows a graph of total pressure spike profiles at a diffuser inlet plane for known turbines and turbines according to embodiments of the invention.

FIG. 10 shows a graph of $P_T$ spike as a function of diffuser inlet plane height. Profile A represents a $P_T$ spike profile for a turbine having angel wing voids according to embodiments of the invention. Profile B represents a $P_T$ spike profile for a turbine having angel wings known in the art. Profile A exhibits an increase in $P_T$ spike at a radially inward position of the diffuser inlet plane.

As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any related or incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A turbine bucket comprising:

a platform portion;

an airfoil extending radially outward from the platform portion;

a shank portion extending radially inward from the platform portion;

an angel wing extending axially from a face of the shank portion; and a plurality of voids disposed along a length of the angel wing, each of the plurality of voids bounded by a convex face and a concave face, each of the plurality of voids extending through the angel wing from a radially outward opening along the convex face to a radially inward opening along the concave face, wherein each of the concave faces is angled with respect to both a longitudinal axis of the turbine bucket and a direction of rotation of the turbine bucket, the radially outward opening trailing the radially inward opening with respect to the direction of rotation of the turbine bucket, wherein the concave face is trailing the convex face relative to the direction of rotation of the turbine bucket.

2. The turbine bucket of claim 1, wherein, in an operative state, the plurality of voids is adapted to impart a curtaining effect on purge air between the angel wing and the platform portion.

3. The turbine bucket of claim 2, further comprising:

a platform lip extending axially from the platform portion.

4. The turbine bucket of claim 1, wherein at least one of the plurality of voids includes a rectangular cross-sectional shape.

5. The turbine bucket of claim 1, wherein the plurality of voids is unevenly distributed along the length of the angel wing.

6. A gas turbine comprising:

a diffuser; and a last stage turbine bucket adjacent the diffuser, the last stage turbine bucket including:

an airfoil extending radially outward from a platform portion;

a shank portion extending radially inward from the platform portion; and an angel wing extending axially from a face of the shank portion, the angel wing including a plurality of voids disposed along a length of the angel wing, each of the plurality of voids bounded by a convex face and a concave face, each of the plurality of voids extending through the angel wing from a radially outward opening along the convex face to a radially inward opening along the concave face, wherein each of the concave faces is angled with respect to both a longitudinal axis of the turbine bucket and a direction of rotation of the last stage turbine bucket, the radially outward opening trailing the radially inward opening with respect to the direction of rotation of the turbine bucket, wherein the concave face is trailing the convex face relative to the direction of rotation of the turbine bucket.

7. The gas turbine of claim 6, wherein, in an operative state, the plurality of voids is adapted to increase a total pressure (PT) spike at an inlet of the diffuser.

8. The gas turbine of claim 7, wherein the plurality of voids is adapted to increase VT near an inner radius of the inlet of the diffuser.

9. The gas turbine of claim 6, wherein, in an operative state, the plurality of voids is adapted to decrease swirl spikes at an inlet of the diffuser.

10. The gas turbine of claim 9, wherein, in an operative state, the plurality of voids is adapted to decrease swirl spikes near an inner radius of the inlet of the diffuser.

11. The gas turbine of claim 6, wherein at least one of the plurality of voids includes a rectangular cross-sectional shape.

12. The gas turbine of claim 6, wherein the plurality of voids is evenly distributed along the angel wing.

13. A turbine bucket comprising:

a platform portion;

an airfoil extending radially outward from the platform portion;

a shank portion extending radially inward from the platform portion;

an angel wing extending axially from a face of the shank portion; and a plurality of voids disposed along a length of the angel wing, each of the plurality of voids bounded by a convex face and a concave face, each of the plurality of voids extending through the angel wing from a radially outward opening along the convex face to a radially inward opening along the concave face, wherein, in an operative state, the plurality of voids is adapted to impart a curtaining effect on purge air between the angel wing and the platform portion, wherein each of the concave faces is circumferentially, radially, and axially angled offset with respect to both a longitudinal axis of the turbine bucket and a direction of rotation of the turbine bucket, the radially outward opening trailing the radially inward opening with respect to the direction of rotation of the turbine bucket, and wherein each of the plurality of voids includes a rectangular cross-sectional shape, wherein the concave face is trailing the convex face relative to the direction of rotation of the turbine bucket.

* * * * *